US005810459A

United States Patent [19]

Barrett et al.

[11] Patent Number: 5,810,459

[45] Date of Patent: Sep. 22, 1998

[54] STACKABLE MODULAR CABINET

[75] Inventors: Joseph C. Barrett, Lino Lakes, Minn.; Richard N. Svenson, Northville, Mich.; Charles R. Weber, Eden Prairie, Minn.; Richard S. McAuley, Costa Mesa, Calif.

[73] Assignee: Unisys Corporation, Blue Bell, Pa.

[21] Appl. No.: 606,812

[22] Filed: Feb. 26, 1996

[51] Int. Cl.[6] ..... F16B 12/00

[52] U.S. Cl. ..... 312/111; 312/108; 312/265.5

[58] Field of Search ..... 312/107, 108, 312/111, 257.1, 263, 265.5, 265.6; 361/724, 725, 726, 727, 732, 683, 829; 220/4.03, 4.02, 3.94

[56] References Cited

U.S. PATENT DOCUMENTS

| | | | |
|---|---|---|---|
| 1,340,562 | 5/1920 | Sandmann | 312/111 X |
| 2,140,376 | 12/1938 | Anderson | 361/829 X |
| 2,686,704 | 8/1954 | Wolters | 312/257.1 |
| 2,959,715 | 11/1960 | Leonchick | 361/725 X |
| 3,307,894 | 3/1967 | Collier | 312/265.2 |
| 3,378,320 | 4/1968 | Morgan et al. | 312/108 |
| 3,421,801 | 1/1969 | Carpenter et al. | 312/111 |
| 3,687,325 | 8/1972 | Simons | 220/3.94 X |
| 3,854,783 | 12/1974 | Teranishi . | |
| 4,474,416 | 10/1984 | Rogahn | 312/263 X |
| 4,650,262 | 3/1987 | Debus et al. | 312/257.1 |
| 4,754,369 | 6/1988 | Nilsson . | |
| 4,786,122 | 11/1988 | Nichoalds . | |
| 4,836,626 | 6/1989 | Taylor . | |
| 5,250,752 | 10/1993 | Cutright . | |
| 5,360,263 | 11/1994 | Nakano et al. . | |

FOREIGN PATENT DOCUMENTS

| | | | |
|---|---|---|---|
| 1330055 | 5/1963 | France | 312/265.5 |
| 757372 | 9/1956 | United Kingdom | 312/265.2 |
| 960363 | 6/1964 | United Kingdom | 312/265.5 |

*Primary Examiner*—Peter M. Cuomo
*Assistant Examiner*—Janet M. Wilkens
*Attorney, Agent, or Firm*—Charles A. Johnson; Mark T. Starr; Beth L. McMahon

[57] ABSTRACT

A stackable modular cabinet having modular, interlocking side units which allow cabinet dimensions to be tailored both vertically and laterally to user needs while also providing the strength and stability to support heavy equipment such as electronic subassemblies. Each side unit has a pair of mating flanges with apertures for receiving and retaining fastening pins that interlock to the fastening pins of a different side unit when the respective flanges of the two side units mate. The interlocked fastening pin structure forms unified rods which extend the full height of the cabinet and which cooperates with the intervening side unit flanges. Each side unit further has re-enforced, double-sided bracket structures at opposing ends which, in combination with the pin structure, provides an unusual amount of strength to the modular cabinet.

42 Claims, 10 Drawing Sheets

22a
28a
74
70
70a
72
56a
75
h1
16
72a
64
68
58a
30a
24a
54a
66
18a
68a
h1
26a
52a
66a
22b
28b
10
20a
56b
70b
72b
h2
58b
30b
54b
36a
18b
38
52b
24b
32
34a
40
36
12
31
36b
34
20b
50
26b
56
34b 50a
42b
56c
58
48
58c
42
54
54c
62a
62c
52c
52
60b
42a
14
46a
44
46
60a
62b

STACKABLE MODULAR CABINET

BACKGROUND OF THE INVENTION

1. Field of the Invention

This invention relates to a modular cabinet design having stackable modules that provide both the rack-mount support and aesthetically pleasing exterior for electrical equipment; and, more particularly, relates to a break-down cabinet design which can be constructed in incremental heights and depths as dictated by the number of stackable modules and the size of the equipment being housed.

2. Description of the Prior Art

Most electrical equipment contains individual subsystems that interconnect to one another to form the overall system. In particular, mid-size and large-scale computing systems often contain subsystems such as instruction processors, memory controllers, memory modules, input/output units, and power and cooling subsystems. Often these subsystems can be packaged together in different configurations to satisfy differing system and performance goals and requirements.

In large-scale and mid-size computer systems, individual subsystems are typically mounted within strong, heavy, rack-mount cabinets. These rack-mount structures must generally satisfy the mounting requirements of the Electronic Industry Association (EIA) standard RS-310. In addition, the cabinet structures must be capable of supporting a large amount of weight while withstanding torquing forces such as those imposed by earthquakes.

Subsystems installed within rack-mount cabinets are interconnected to form an overall system. Then metal covers called "skins" are installed over the rack-mount structures to enclose the system for safety and to provide an aesthetically-pleasing appearance.

Typically, the subsystems of a computing system can be packaged together in several combinations, often referred to as configurations. This allows systems to be tailored to individual user needs. A low-end system, for example, could be configured to include only one instruction processor and a small amount of memory, whereas another system may contain multiple instruction processors and a large memory. This flexibility allows users to expand their systems as their computing needs grow.

In the past, rack-mount cabinetry was available in only a limited number of sizes. Users desiring systems that did not conform to one of the available cabinet sizes were forced to purchase cabinets that were too large. In addition, users desiring system upgrades were forced to purchase entirely new cabinets if existing space did not allow for additional subsystems or modules. As a result, users of low-end machines or those anticipating upgrades were often forced to purchase cabinets larger than necessary, adding unneeded size and expense to their systems. In addition to the cabinet cost, this often required use of a larger area of floor support, thereby increasing the facility cost.

Manufacturers of electronic and computer systems have long been searching for a more adaptable cabinet design. Nilsson, U.S. Pat. No. 4,754,369, teaches a lightweight, stiff structure containing removable box-section end walls which are fastened to the cleats of a base plate. Although the knock-down walls make the system much more transportable, the cabinet dimensions can not be varied. Taylor, U.S. Pat. No. 4,836,626, teaches a knockdown cabinet design which can be assembled without the use of tools and with only a minimum number of plastic plugs.

Like Nilsson, however, the cabinet can not be incrementally expanded. Cutright, U.S. Pat. No. 5,250,752, teaches a knockdown shielded electronic rack enclosure incorporating the use of squaring corner brackets for joining adjacent vertical side wall frames to the horizontal top and bottom frame components. These corner joints prevent torquing and provide additional stability. Although the structure provides improved rigidity, the design can not be expanded.

Expandable design structures have been disclosed for uses other than those associated with electronics equipment. Teranishi, U.S. Pat. No. 3,854,783, teaches a modular shelf structure which can be easily assembled and disassembled, and which can be expanded both vertically and horizontally. The Teranishi design receives much of its structural support through the use of block modules, each formed by a bottom panel, two side panels, and an interlocking top panel. While providing expandability and rigidity, this block module structure including the integrated bottom panel is not well suited to housing electronic equipment, the components of which are operationally interconnected, such as by cables, or otherwise fitted together. In the past, expandable structures formed of just expandable side panels without the intervening horizontal panels were considered much too unstable to support the weight associated with electronic equipment.

OBJECTS

It is a primary objective of this invention to provide an improved cabinet for housing electrical equipment.

It is a further object of this invention to provide a modular cabinet structure comprised of individual modules which can be stacked to produce enclosures of variable heights and depths.

Yet another object of the invention is to provide a modular cabinet structure comprised of stackable modules that can be interlocked to provide structural strength.

Still another object of the invention is to provide expandable modules for use in a modular cabinet.

Another object of the invention is to provide an interlocking mechanism for interlocking adjoining modules and providing structural strength for a modular cabinet.

It is still a further object of this invention to provide a stackable modular cabinet structure having the strength to support large electrical subsystems.

It is another object of this invention to provide a stackable modular cabinet structure conforming to the Electronic Industry Association (EIA) standard RS-310 requirements.

It is yet another object of this invention to combine the dual functionality of support and aesthetics into a single structure which thereby replaces both the rack mount cabinet and the skin coverings.

It is another object of this invention to provide a structure which can be easily and quickly constructed.

It is still another object of this invention to provide a structure which can be easily and quickly expanded with a minimum of system disturbance.

It is yet a further object of this invention to provide a cost-effective structure for housing electrical equipment.

Without departing from the spirit and scope of the invention, other more detailed objectives will become apparent to those skilled in the art from a consideration of the Drawings and the Detailed Description of the Preferred Embodiment.

SUMMARY OF THE INVENTION

The stackable modular cabinet disclosed herein provides a cabinet design which can be easily and quickly expanded vertically by adding modular units. In addition to providing modularity, the design exhibits strength and stability through the use of a unique module interconnection system, and a double-sided, reinforced corner design. The constructed cabinet is able to support a large amount of weight while resisting torquing forces. Moreover, the cabinet provides a cost-effective alternative to the frame-and-skins combination traditionally used to house electronic equipment. The modular side units, which are formed of a strong, light-weight material such as commercially-available cold-rolled steel, provide both the support structure and the aesthetically-pleasing coverings for the electronic subassemblies housed therein.

Finally, the design allows for easy lateral expansion to accommodate larger subassemblies or large cabling requirements.

The stackable modular cabinet consists of a base unit, one or more stackable modules stacked upon the base unit, and a cover unit. Each of the stacked modules are generally comprised of two side units, a front fascia panel, a back panel, and two optional side extension units.

The current modular cabinet design overcomes deficiencies in prior designs and is able to provide the needed strength through a unique pin interlocking mechanism which attaches the modular side units at selected locations, such as at the corners.

Mating pins having interlocking structures at each end form the basis of this interlocking mechanism.

The pin receiving structures are formed by cabinet support members at two opposite edges of the modular side units. In the preferred embodiment, these cabinet support members are flanges formed to provide upper and lower mating shelves. These flanges contain pin-retaining apertures into which the mating pins are inserted and retained. Side units are then interconnected by mating the flanges from first and second side units so that the pins from the first side unit may be interlocked to those of the second side unit.

The resulting interlocking pin structure provides strength and stability in two dimensions. When multiple side units are interconnected, the interlocked pins form unified steel rods which further interlock with the base unit and extend the full combined height of the cabinet at every corner. These rods further incorporate and interlock with the side unit flanges running approximately perpendicular to the interconnected pins The resulting support structure formed by the interlocked side units therefore consists of steel rods and intervening flanges positioned into a rigid grid structure.

Strength is further added by the unique side unit corner design. The side units have channels at the edges adjacent to the flanges to form double-sided end coupling structures, which in the preferred embodiment are brackets. These bracket structures are further mounted to re-enforcing stiffening members which interlock with the side unit flanges to strengthen the side units at the corner edges. In the preferred embodiment, these stiffening members are re-enforcing support joints.

The cabinet contains rack structures mounted to the re-enforcing support joints which provide the support for the enclosed electronic subassemblies. Although the cabinet could be used to house subassemblies without actually attaching the equipment to the cabinet structure, interlocking equipment to the cabinet frame provides an additional measure of stability. When a subassembly is in place, the corner bracket device-mounting apertures can be used to lock the subassembly into position between the two side units. By attaching the side units to the subassembly at all corners, the corner rods and side flanges are further locked into positioned with respect to one another. A cover unit and a base support unit may be interlocked with the opposing side units of the top and bottom subassembly modules, respectively, thereby even further locking the two side structures into a fixed alignment with one another.

The depth of any module within the stackable modular cabinet may be easily expanded by adding side extension units. The side extension units have bracket structures similar to those of the side units, and to which the displaced back panel may be remounted.

DESCRIPTION OF THE PREFERRED EMBODIMENT

Figure 1:
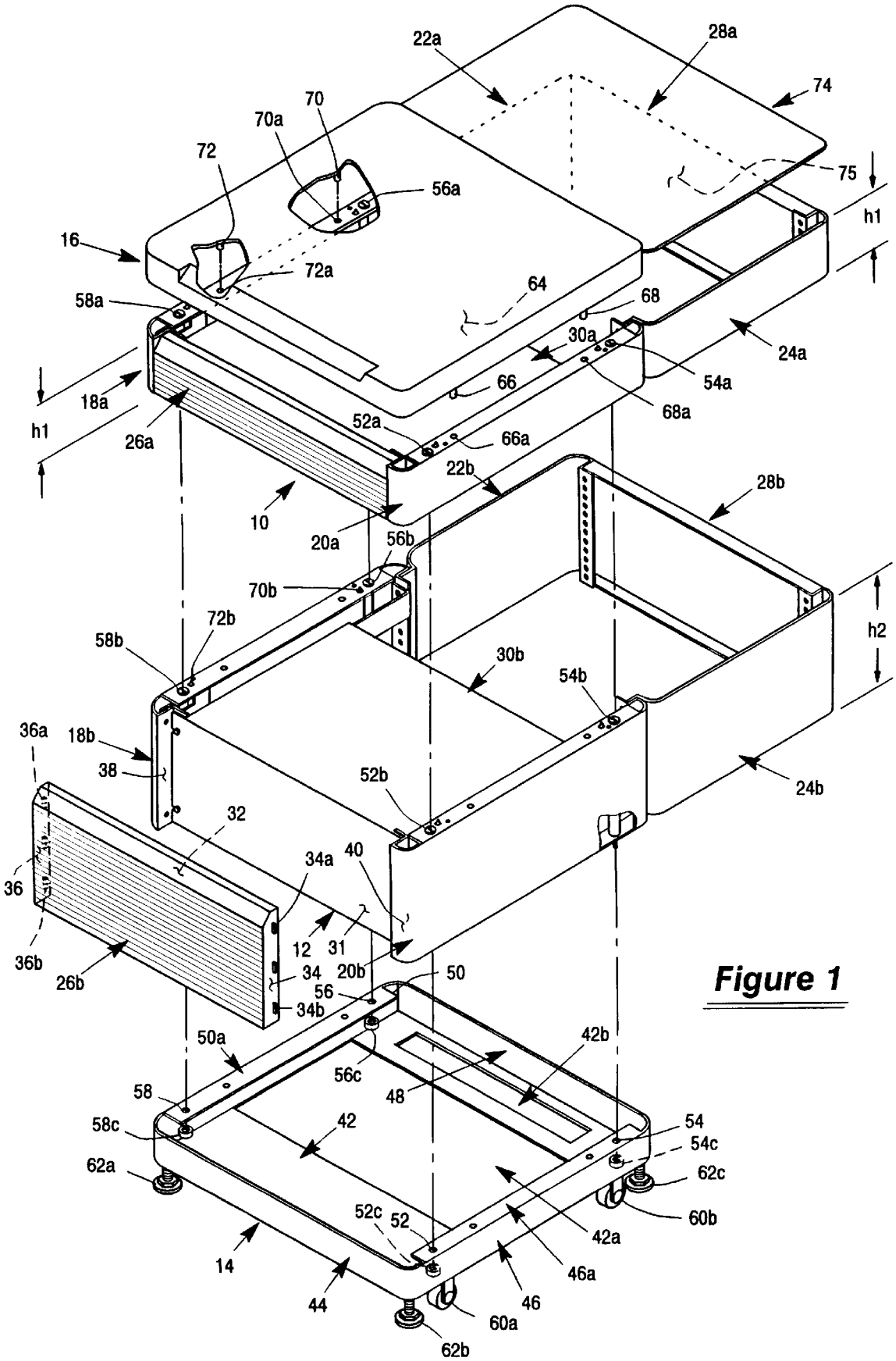
FIG. 1 is an exploded perspective view of a stackable modular cabinet that includes extension modules.

FIG. 1 is an exploded perspective view of a stackable modular cabinet that includes side extension modules. Two stackable modules 10 and 12 are situated between a base unit 14, and a cover unit 16. Module 12 attaches to base unit 14, module 10 attaches to module 12, and cover unit 16 attaches to module 10 through a structural interlocking mechanism that will be described in more detail below.

Although only two stackable modules 10 and 12 are shown, it is understood that more modules may be included. The modules may be of like dimensions, or they may be of varying heights. In the preferred embodiment, the height of the modules varies in fixed increments of 1.750 inches, which is an increment well-known in the electronics cabinet industry as 1 "Unit" or 1 "U". In FIG. 1, module 10 illustratively has a height h1 of 3 Us, whereas module 12 illustratively has a height h2 of 9 Us. It is of course understood that more or fewer modules can be utilized, and the each module can be selected to its required height.

Each stackable module contains similar structural components and is constructed in a similar manner. The module components are formed of a strong, light-weight, material such as commercially-available cold-rolled steel. Module components include two side units, a front fascia panel, and a back panel. In addition, each module may optionally include side extension units to increase cabinet dimensions. The stackable modules 10 and 12 are shown connected to associated extension units, though it should be understood that extensions are not required in all cases.

Module 10 has a side unit 18*a* attached to side extension unit 22*a* (shown dashed), and a side unit 20*a* attached to side extension unit 24*a*. The attachment of the side units to the side extension units is described in detail below. Side unit 18*a* interlocks to two fastening pins 56*a* (shown dashed) and 58*a*, and side unit 20*a* interlocks to two fastening pins 52*a* and 54*a*. Fastening pins 52*a*, 54*a*, 56*a* and 58*a* provide the means of interlocking module 10 to module 12. The means of interlocking fastening pins to a side unit to thereby attach one module to another module will be described in detail below.

Module 10 also has a front fascia panel 26*a* and a back panel 28*a*. The front fascia panel 26*a* mates with side units 18*a* and 20*a*. The attachment of the front fascia panels to the side units will be described in detail below. Back panel 28*a* is connected at each end to side extensions units 22*a* and 24*a*, respectively. If the optional extension units were not employed in this implementation, back panel 28*a* would be connected at each end to side units 18*a* and 20*a*, respectively. The attachment of the back panels to the side extension units, or alternately to the side units, is described in detail below. Finally, module 10 is shown housing electronic subassembly 30*a*. The attachment of an electronic subassembly to a side unit is described below.

Module 12 has two side units 18*b* and 20*b*. Side unit 18*b* has a mating surface 38, and side unit 20*b* has a intermediate mating surface 40. Side unit 18*b* interlocks to two fastening pins 56*b* and 58*b*, and side unit 20*b* interlocks to two fastening pins 52*b* and 54*b*. Fastening pins 52*b*, 54*b*, 56*b* and 58*b* provide the means of interlocking module 12 to base unit 14 and of further interlocking module 12 to module 10. The means of interlocking fastening pins to a side unit to thereby attach one module to another module will be described in detail below.

Module 12 further has side extension units 22*b* and 24*b*. Side unit 18*b* is attached to side extension unit 22*b*, and side unit 20*b* is attached to side extension unit 24*b*. The attachment of the side units to the side extension units is discussed in detail below. Module 12 houses an electronic subassembly 30*b*, which has a front mating surface 31.

Module 12 also has a front fascia panel 26*b*. Front fascia panels 26*a* and 26*b* provide aesthetic appeal to the stackable modules 10 and 12, respectively. The module 10 front fascia panel 26*a* is shown installed, whereas front fascia panel 26*b* is shown disconnected from module 12.

Front fascia panel 26*b* has a unit mating surface 32, a first tab surface 34, and a second tab surface 36. First tab surface 34 has two spring-loaded tabs 34*a* and 34*b*, and second tab surface has two spring-loaded tabs 36*a* and 36*b*. Spring-loaded tabs 34*a*, 34*b*, 36*a*, and 36*b* can be depressed to allow the unit mating surface 32 to mate with the front mating surface 31 of electronic subassembly 30*b*. When the spring-loaded tabs are then released, tabs 34*a* and 34*b* mate with and exert pressure against intermediate mating surface 40 of side unit 20*b*. Likewise, tabs 36*a* and 36*b* mate with and exert pressure against intermediate mating surface 38 of side unit 18*b*. The pressure exerted by the tabs holds the front fascia panel 26*b* to module 12, while allowing easy removal if desired.

Although the foregoing discussion describes the front fascia panel 26*b* of module 12, it is understood that all front fascia panels have the same attributes and attach to their respective modules in the manner described above. Finally, it should be mentioned that front fascia panels merely provide aesthetic appeal, not structural support, to the cabinet. It is understood the cabinet could be constructed without these additional components.

Module 12 further has a back panel 28*b*, which is connected at each end to side extensions units 22*b* and 24*b*, respectively. If the optional extension units were not employed in this implementation, back panel 28*b* would be connected to side units 18*b* and 20*b*. The attachment of the back panels to the side extension units is described in detail below.

The base unit 14 of the preferred embodiment is a support structure formed of a strong, sturdy material such as commercially-available cold-rolled steel. Base unit 14 has a floor structure 42 having cut-away portions 42*a* and 42*b* which allow cables or other interconnecting devices (not shown) to be connected to the electronic subassemblies 30*a* and 30*b*. The floor structure 42 is attached to four side walls 44, 46, 48, and 50. Side walls 46 and 50 are formed with support flanges 46*a* and 50*a*, respectively. Flange 46*a* has base holes 52 and 54 for receiving the fastening pins 52*b* and 54*b*, respectively, which attach side unit 20*b* to base unit 14. Likewise, flange 50*a* has base holes 56 and 58 for receiving the fastening pins 56*b* and 58*b*, respectively, which attach side unit 18*b* to base unit 14. The attachment of side units 18*b* and 20*b* to the base unit 14 will be described below.

In the preferred embodiment, the base unit 14 is supported by casters at the corners, illustratively shown as 60*a* and 60*b*, which are attached to the floor structure 42 to aid in cabinet mobility. Retractable stabilizing structures at the corners, illustratively shown as 62*a*, 62*b* and 62*c*, are used after the cabinet has been positioned to prevent inadvertent cabinet motion. It is understood that the floor structure 42 could be supported by any support structures, or alternately could rest directly on the floor.

As mentioned above, stackable module 12 is attached to base unit 14 with four fastening pins 52*b*, 54*b*, 56*b*, and 58*b*. Each of these fastening pins is interlocked to a respective side unit, and further inserted into a respective base hole. Fastening pins 52*b* and 54*b* interlock to side unit 20*b* and are further inserted into base holes 52 and 54, respectively. Fastening pins 52*b* and 54*b* are secured to flange 46*a* by securing devices (such as nuts) 52*c* and 54*c*, respectively. Likewise, fastening pins 56*b* and 58*b* interlock to side unit 18*b* and are further inserted into base holes 56 and 58, respectively. Fastening pins 56*b* and 58*b* are secured to flange 50*a* by securing devices 56*c* and 58*c*, respectively. The fastening pin structure, as well as the mechanism which interlocks the fastening pins to a respective side unit, will be described below.

Stackable module 10 is attached to stackable module 12 with four fastening pins 52*a*, 54*a*, 56*a*, and 58*a* which interlock with fastening pins 52*b*, 54*b*, 56*b*, and 58*b*, respectively. Fastening pins 52*a* and 54*a* interlock to side unit 20*a* and further interlock to the side unit 20*b* fastening pins 52*b* and 54*b*, respectively. Fastening pins 56*a* and 58*a* interlock to side unit 18*a* and further interlock to the side unit 18*b* fastening pins 56*b* and 58*b*, respectively. The fastening pin interlocking mechanism is described in detail below.

Cover unit 16 has a cover mating surface 64. Cover mating surface 64 has fastening pegs 66, 68, 70 and 72 for positioning and fastening cover unit 16 to stackable module 10. Fastening pegs 66 and 68 interlock with the side unit 20*a* cover holes 66*a* and 68*a*, respectively. Likewise, fastening pegs 70 and 72 interlock with the side unit 18*a* cover holes 70*a* and 72*a*, respectively. Although cover unit 16 includes pegs integrally formed thereto, it is understood that cover 16 could be fastened to a stackable module using any commercially available fastening device, including screws, which would interlock with the side unit cover holes.

Extension cover 74 provides the top surface for the optional extension module formed by side extension units 22*a*, 24*a*, 22*b*, and 24*b*. Extension cover 74 has a mating surface 75 for attaching on each side to side extension units 22*a* (shown dashed) and 24*a*, respectively.

The FIG. 1 stackable modules 10 and 12 each contain two side units of like height. For example, module 12 contains side units 18*b* and 20*b*, and each side unit is of a height h2 illustratively shown as 9 Us. It should be understood that one or both sides of module 12 could consist of multiple side units with a combined height of 9 Us interlocked with fastening pins to form a single side unit. For example, one or both sides of the module 12 could consist of three side units, each having a height h1 of 3 Us. The combined height of the three modules after being interlocked as described below would be 9 Us.

Furthermore, the stackable module cabinet of FIG. 1 is shown housing electronic subassemblies 30*a* and 30*b*. It is understood, however, that the stackable module cabinet disclosed herein is suitable for housing other types of equipment.

Finally, it should be reiterated with respect to FIG. 1, that although one stackable module is of the same construction as, and contains components that are similar to, any other stackable module, the components within a stackable module do vary with respect to height. These height variations allow each module to be constructed according to the size of the electronic subassembly to be enclosed therein.

Figure 2:
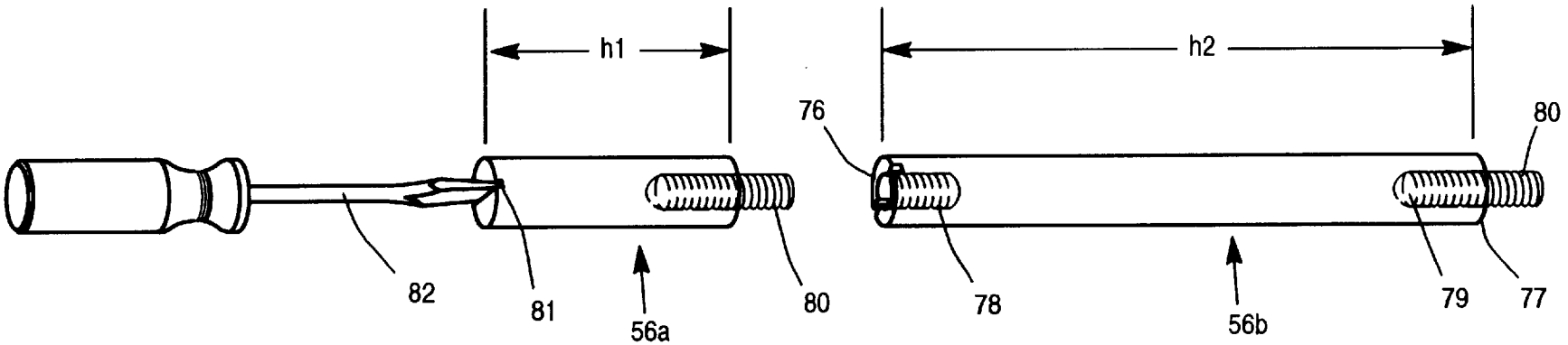
FIG. 2 is an exploded perspective view of interlocking fastening pins.

FIG. 2 is an exploded perspective view of fastening pin 56*a* as it interlocks with fastening pin 56*b*. All fastening pins in a stackable modular cabinet are of similar construction, though they may be of different lengths. It is therefore understood that the following description applies to any and all fastening pins in a stackable modular cabinet.

Each fastening pin has a predetermined length, which is a multiple of a predetermined increment. In the preferred embodiment, the increment is 1 U. As mentioned above, the length of a fastening pin is determined by the height of the side unit with which it is associated. Fastening pin 56*a* has a length h1 of approximately 3 Us, whereas fastening pin 56*b* has a length h2 of approximately 9 Us.

Fastening pin 56*b* in the preferred embodiment is of a generally cylindrical construction. Fastening pin 56*b* has a receiving end 76, and an insertion end 77. Receiving end 76 has a bored and tapped receiving channel 78, and insertion end 77 has a bored and tapped insertion channel 79. Fastening pin 56*b* further has a threaded peg 80 inserted into tapped insertion channel 79, and which extends beyond the insertion end of fastening pin 56*b*. For illustrative purposes, peg 80 is shown as a separate component interlocked with tapped insertion channel 79, but it is understood peg 80 could be integrally formed and threaded as part of insertion end 77.

The threaded peg 80 of any fastening pin is designed to interlock with the tapped receiving channel 78 of a different associated fastening pin. As shown, peg 80 of fastening pin 56*a* is designed to interlock with the receiving channel 78 of fastening pin 56*b*. The receiving end 76 of any fastening pin further has an insertion slot 81 for receiving an insertion tool, illustratively shown in FIG. 2 as screw driver 82. The insertion tool is used to aid insertion of peg 80 of fastening pin 56*a* into the receiving channel 78 of fastening pin 56*b*. Pins 56*a* and 56*b* are illustrated as being interlocked by a threaded interlocking structure. It should be understood that other interlocking mechanisms could be used provided that the resultant interlocked pin structure is substantially rigid when in place.

Figure 3:
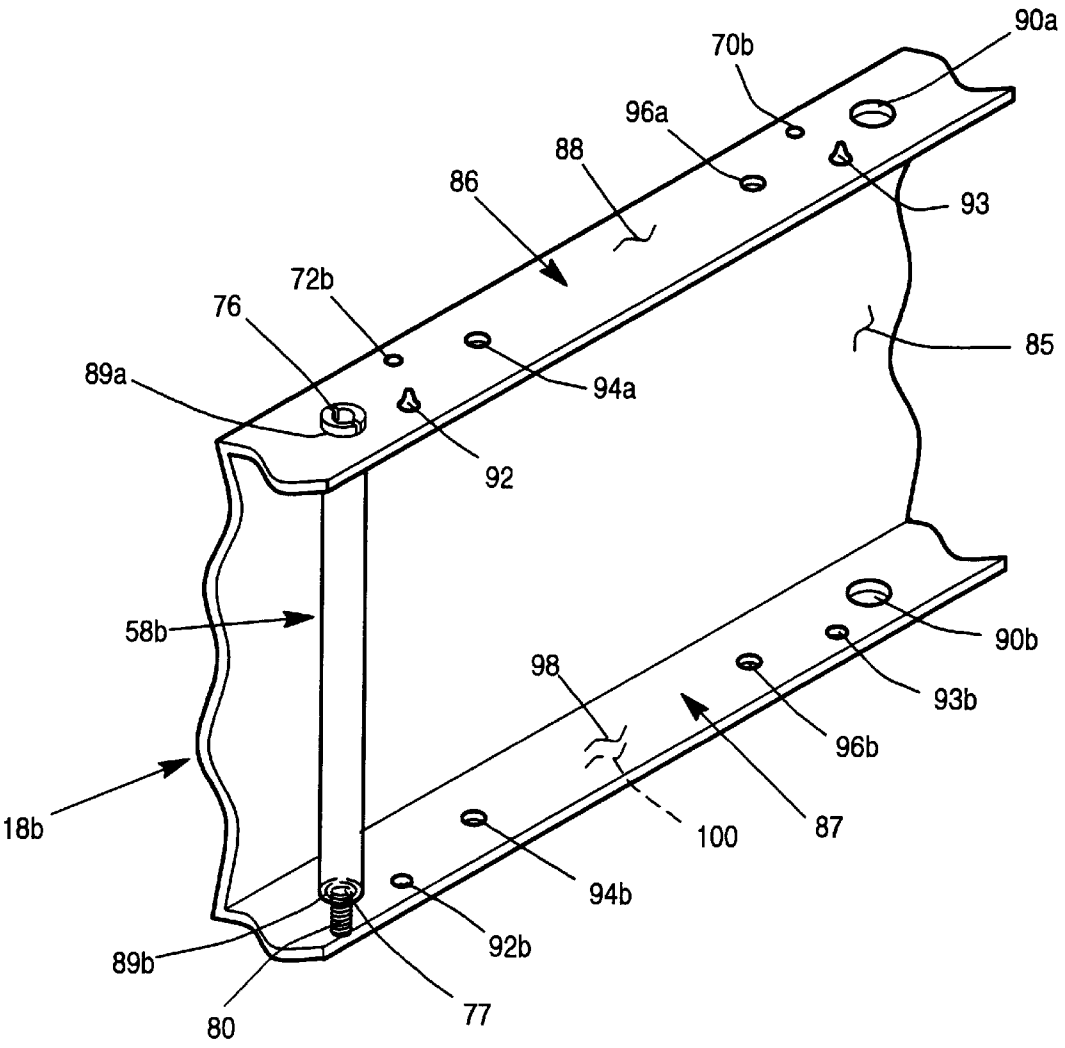
FIG. 3 is a cutaway perspective view of a side unit and shows a fastening pin inserted in the side unit pin holes.

FIG. 3 is a cutaway perspective view of side unit 18*b* and shows a fastening pin 58*b* inserted in side unit pin holes 89*a* and 89*b*. Side unit 18*b* has an interior surface 85, and two cabinet support members which in the preferred embodiment consist of an upper mating flange 86 and a lower mating flange 87. Both the upper mating flange 86 and the lower mating flange 87 are bent at a predetermined angle to the interior surface 85 to form upper and lower mating shelves. In the preferred embodiment, this angle is approximately 90 degrees. Upper mating flange 86 has a top mating surface 88, two upper pin holes 89*a* and 90*a*, two positioning guides 92 and 93, two cover holes 72*b* and 70*b*, and two top threaded attachment holes 94*a* and 96*a*. Lower mating flange 87 has a top support surface 98, a bottom mating surface 100, two lower pin holes 89*b* (shown dashed) and 90*b*, two bottom attachment through holes 94*b* and 96*b*, and two positioning holes 92*b* and 93*b*.

Fastening pin 58*b* is inserted into upper pin hole 89*a* so that insertion end 77 mates with support surface 98 and so that peg 80 extends through lower pin hole 89*b*. When fastening pin 58*b* is inserted into side unit 18*b*, receiving end 76 is approximately flush with top mating surface 88. Fastening pin 56*b* (not shown in FIG. 3) is mounted in a similar manner. While the above discussion refers to side unit 18*b* and the insertion of pin 58*b* into associated pin holes of side unit 18*b*, it is understood that this description applies to any side unit and to any fastening pin interlocked with a side unit.

Figure 4:
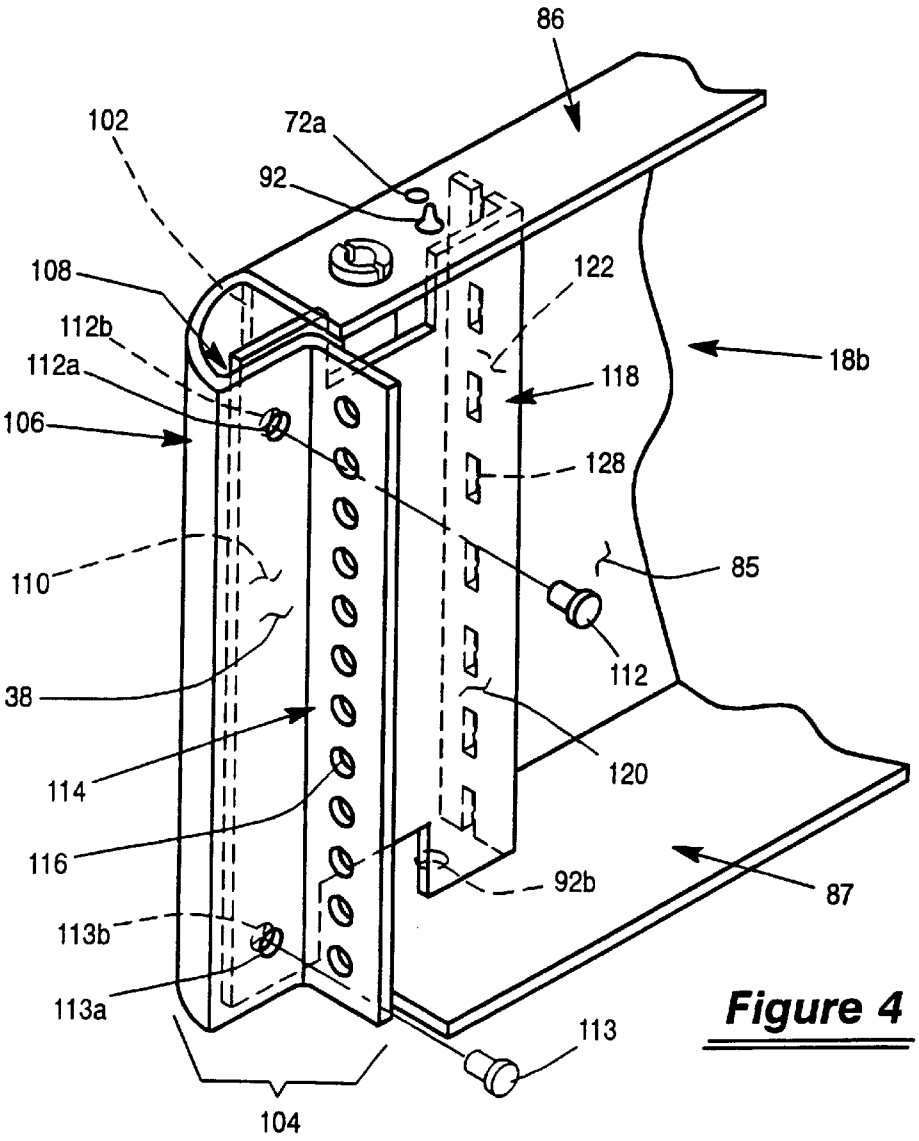
FIG. 4 is cutaway perspective view of a side unit bracket attached to a rack-mount joint.

FIG. 4 is a cutaway perspective view of a side unit bracket attached to a rack-mount joint. Although the following discussion uses side unit 18*b* and front bracket 104 for explanative purposes, the description applies to any bracket of any side unit or side extension unit in the stackable modular cabinet. Side unit 18*b* has a front edge 102 coupled to a first end coupling structure. In the preferred embodiment, the first end coupling structure is front bracket 104, which is integrally formed to front edge 102, although it is understood that front bracket 104 could be a separately formed component attached to side unit 18*b* with commercially available fasteners. In the preferred embodiment, front bracket 104 has a first transitional portion 106 which consists of an arcuate bend of approximately 90 degrees formed towards interior surface 85. Front bracket 104 further has an intermediate portion 108 which in the preferred embodiment is approximately parallel to interior surface 85. Intermediate portion 108 has a mating surface 38 for mating with second tab surface 36 of front fascia panel 26*b*, as explained above. Intermediate portion 108 further has a rack-mount joint mating surface 110, and two mounting holes 112*a* and 113*a*. Finally, front bracket 104 has a terminating portion 114, which in the preferred embodiment is at an approximate right angle from intermediate portion 108, and which has a plurality of device mounting holes 116. In the preferred embodiment, the device mounting holes 116 are positioned to be consistent with the Electronic Industries Association (EIA) Standard RS-310.

Front bracket 104 is attached to a stiffening member, which in the preferred embodiment is a rack-mount joint 118 that is fitted between upper mating flange 86 and lower mating flange 87. Rack-mount joint 118 has a bracket mating surface 120, and a rack support surface 122. Bracket mating surface 120 mates with rack-mount joint mating surface 110, thereby providing added strength and stability to front bracket 104. Bracket mating surface 120 further has two bracket mating holes 112*b* and 113*b* (shown dashed). Rack-mount joint 118 is attached to front bracket 104 by inserting fastener 112 through mounting hole 112*a* and through bracket mating hole 112*b*, and by further inserting fastener 113 through mounting hole 113*a* and through bracket mating hole 113*b*. In the preferred embodiment, fasteners 112 and 113 are screws, but other fastening mechanisms could be utilized.

Rack support surface 122 is at a predetermined angle from bracket mating surface 120, which in the preferred embodiment is approximately 90 degrees. Rack support surface 122 has a plurality of rack-mount slots 128 (shown dashed.)

Figure 5:
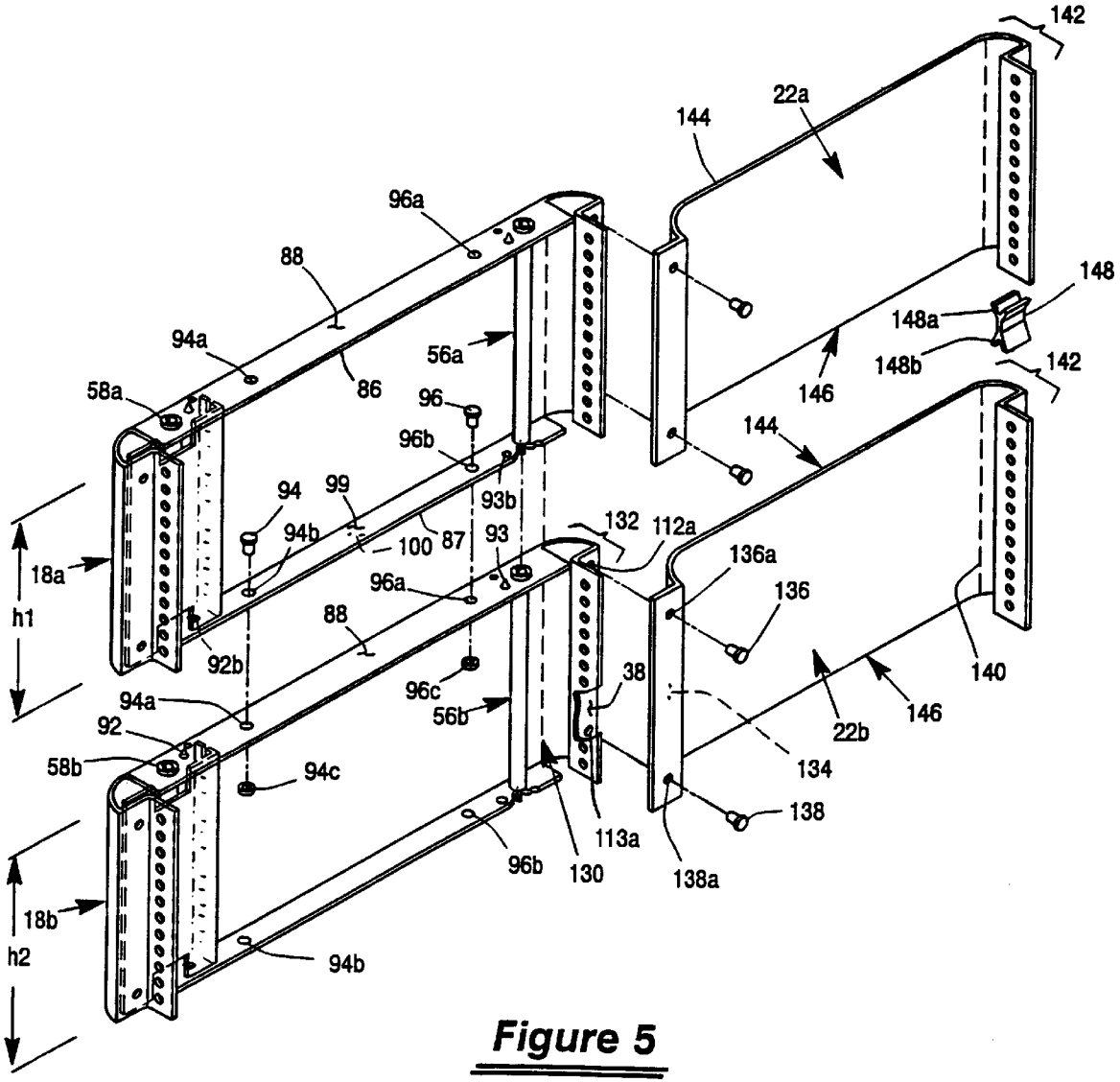
FIG. 5 is an exploded perspective view of first and second side units, and first and second side extension units, and shows how the side units attach to one another and to respective side extension units.

FIG. 5 is an exploded perspective view of two side units and two corresponding side extension units, and shows how a side unit attaches to another side unit and to its corresponding side extension unit. Although side units 18*a* and 18*b* and the corresponding side extension units 22*a* and 22*b* are used for explanative purposes, it is understood that the following detailed description also applies to the attachment of any side unit to another side unit or to its corresponding side extension unit.

FIG. 5 further shows fastening pins inserted into the corresponding pin holes of the corresponding side units. Fastening pin 56*a* is inserted into the upper and lower pin holes in flanges 86 and 87, respectively, of side unit 18*a* so that threaded peg 80 of fastening pin 56*a* extends through flange 87. Fastening pin 58*a* is inserted in a like manner in side unit 18*a*. Fastening pins 56*b* and 58*b* are likewise inserted into pin holes of side unit 18*b*.

Side unit 18*a* is aligned with side unit 18*b* by fitting positioning extensions 92 and 93 of side unit 18*b* into positioning holes 92*b* and 93*b*, respectively, of side unit 18*a* so that top mating surface 88 of side unit 18*b* mates with bottom mating surface 100 of side unit 18*a*. To maintain this positioning, fastener 94 is inserted through bottom attachment hole 94*b* of side unit 18*a*, further inserted through top attachment hole 94*a* of side unit 18*b*, and secured by securing device 94*c*. Likewise, fastener 96 is inserted through bottom attachment hole 96*b* of side unit 18*a*, further inserted through top attachment hole 96*a* of side unit 18*b*, and secured by securing device 96*c*. In the preferred embodiment, fasteners 94 and 96 are screws.

After side unit 18*a* is positioned next to side unit 18*b*, fastening pins 56*a* and 58*a* may be interlocked with fastening pins 56*b* and 58*b*, respectively. As described above, peg 80 of fastening pin 56*a* is inserted into the receiving channel 78 of fastening pin 56*b* so that threaded peg 80 is screwed into and interlocked with tapped receiving channel 78, and so that the receiving end 76 of fastening pin 56*b* mates with bottom mating surface 100 of side unit 18*a*. An insertion tool may be used with insertion slot 81 of fastening pin 56*a* to aid in this interlocking process. Likewise, fastening pins 58*a* and 58*b* are interlocked in a similar manner.

It is understood that threaded pegs 80 of fastening pins 56*b* and 58*b*, respectively, could be received by the receiving channels of corresponding fastening pins inserted in an additional side unit, if bottom mating surface 100 of side unit 18*b* were mating with the additional side unit of yet another module. However, in the cabinet of FIG. 1, bottom mating surface 100 of side unit 18*b* mates with flange 50*a* of base unit 14. Therefore, pegs 80 of fastening pins 56*b* and 58*b*, respectively, are received by base holes 56 and 58, respectively, and secured by securing devices 56*c* and 58*c*, respectively, to fasten side unit 18*b* to base unit 14.

It is further understood that receiving channels 78 of fastening pins 56*a* and 58*a*, respectively, could receive the pegs 80 of corresponding fastening pins inserted in yet another additional side un it if top mating surface 88 of side unit 18*a* were mating with an additional module. However, top mating surface 88 of side unit 18*a* mates with cover mating surface 64, as shown in FIG. 1. Therefore receiving ends 76 of fastening pins 56*a* and 58*a*, respectively, also mate with cover mating surface 64.

It may be further noted that cover holes 70*b* and 72*b* of side unit 18*b* are unused, since top mating surface 88 of side unit 18*b* mates with bottom mating surface 100 of side unit 18*a*. However, if module 10 were removed from the cabinet of FIG. 1 so that top mating surface 88 of side unit 18*b* mated with cover mating surface 64, cover holes 70*b* and 72*b* would receive fastening pegs 70 and 72 respectively.

Side panel 18*b* farther has a back edge 130 coupled to a second end coupling structure. In the preferred embodiment, the second end coupling structure is back bracket 132, which is integrally formed to back edge 130, although it is understood that back bracket 132 could be a separate component attached to side panel 18*b* instead of being integrally formed thereto. Back bracket 132 has all attributes described above in relation to FIG. 4.

Side extension units 22*a* and 22*b*, which are optionally attached to respective side units 18*a* and 18*b*, are available to increase cabinet capacity. Although the following discussion illustratively uses side extension unit 22*b*, it is understood the description applies to any side extension unit.

Side extension unit 22*b* has a bracket mating surface 134 for mating with the mating surface 38 of back bracket 132. Bracket mating surface 134 further has two back bracket mating holes 136*a* and 138*a* for receiving fasteners 136 and 138, respectively. Fasteners 136 and 138 are further inserted into mounting holes 112*a* and 113*a*, respectively, thereby attaching side extension unit 22*b* to side unit 18*b*.

Side extension unit 22*b* has an extension edge 140 integrally formed to an extension bracket 142, although it is understood that extension bracket 142 could be a separate component attached to side panel 22*b* rather than being integrally formed therewith. Extension bracket 142 has all attributes of the bracket described above in relation to FIG. 4.

Side extension unit 22*b* further has a top extension edge 144, and a bottom extension edge 146. When side extension unit 22*a* is attached to side unit 18*a*, side extension unit 22*b* is attached to side unit 18*b*, and side unit 18*a* is attached to side unit 18*b*, top extension edge 144 of side unit 18*b* is aligned with bottom extension edge 146 of side unit 18*a*. This relationship is maintained by spacer 148. Spacer 148 has a top spacer groove 148*a* for receiving bottom extension edge 146 of side extension unit 22*a*, and further has a bottom spacer groove 148*b* for receiving top extension edge 144 of side unit 18*b*. A similar spacer is inserted between every stacked pair of side extension units in the stackable modular cabinet of FIG. 1 to provide alignment and added stability to the extension structure.

Figure 6:
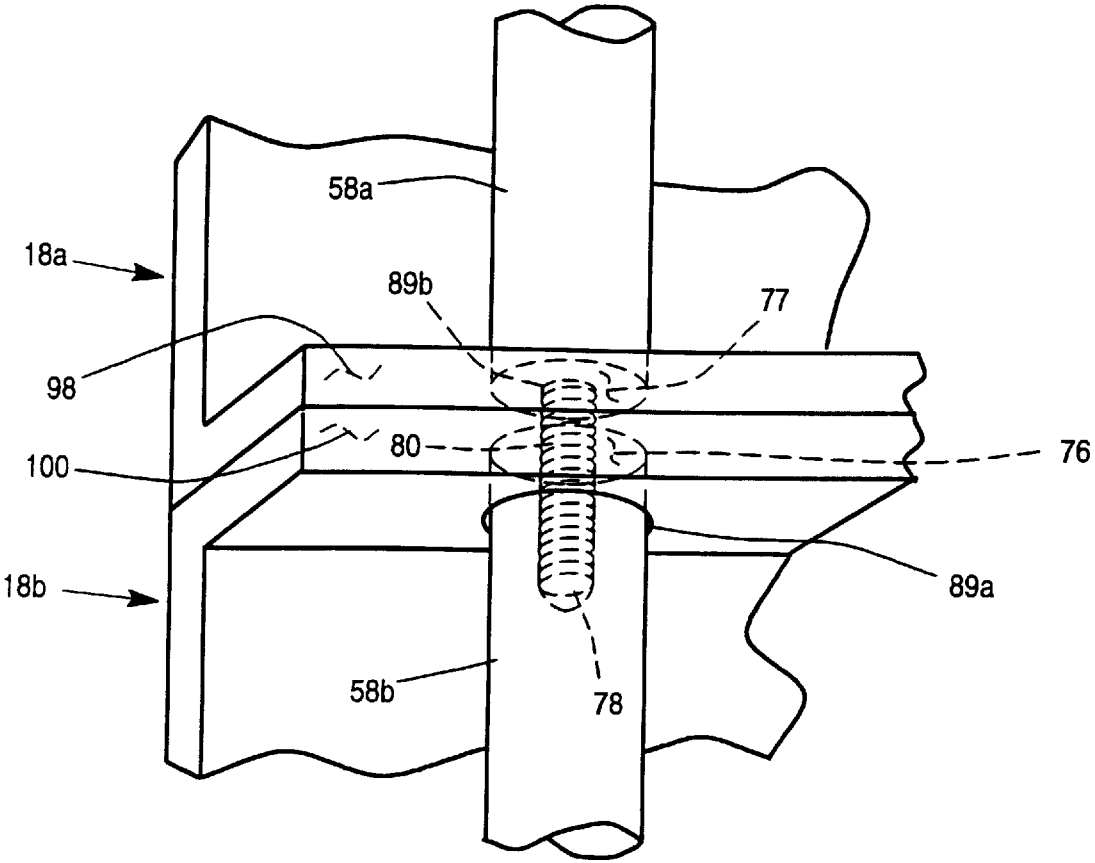
FIG. 6 is a cutaway close-up perspective view of two fastening pins interlocked to attach a first side unit to a second side unit.

FIG. 6 is a cutaway close-up perspective view of fastening pins 58*a* and 58*b* interlocked to attach side units 18*a* and 18*b*. Insertion end 77 of fastening pin 58*a* mates with bottom support surface 98 of side 18*a*. Peg 80 of fastening pin 58*a* extends through lower pin hole 89*b* of side unit 18*a*, extends further through upper pin hole 89*a* of side unit 18*b*, and interlocks with tapped receiving channel 78 of fastening pin 58*b*. Receiving end 76 of fastening pin 58*b* mates with bottom mating surface 100 of side unit 18*a*.

The fastening pins are integral to the corner structure design of the stackable modular cabinet. When interlocked as shown in FIG. 6, fastening pins form four unified corner structures that extend from base unit 14 to the cover unit 16 at the corners of the cabinet. These structures interconnect adjacent modules one with another. Moreover, these unique interlocking pin structures incorporate intervening perpendicular structures created by the mating side unit flanges. The two pin structures associated with any given side unit are therefore locked into a grid-like side structure that provides strength and stability in two dimensions. When the two side structures of a cabinet are further attached to electronic subassembly frames, as will be discussed below, the subassemblies lock the two grid-like side structures into a relationship with one another. This adds strength and stability in yet another dimension. Therefore, the unique pin structure ultimately forms the basis of a very strong three-dimensional grid which is lightweight and expandable, while still being capable of withstanding large torquing forces and supporting very heavy equipment.

Figure 7:
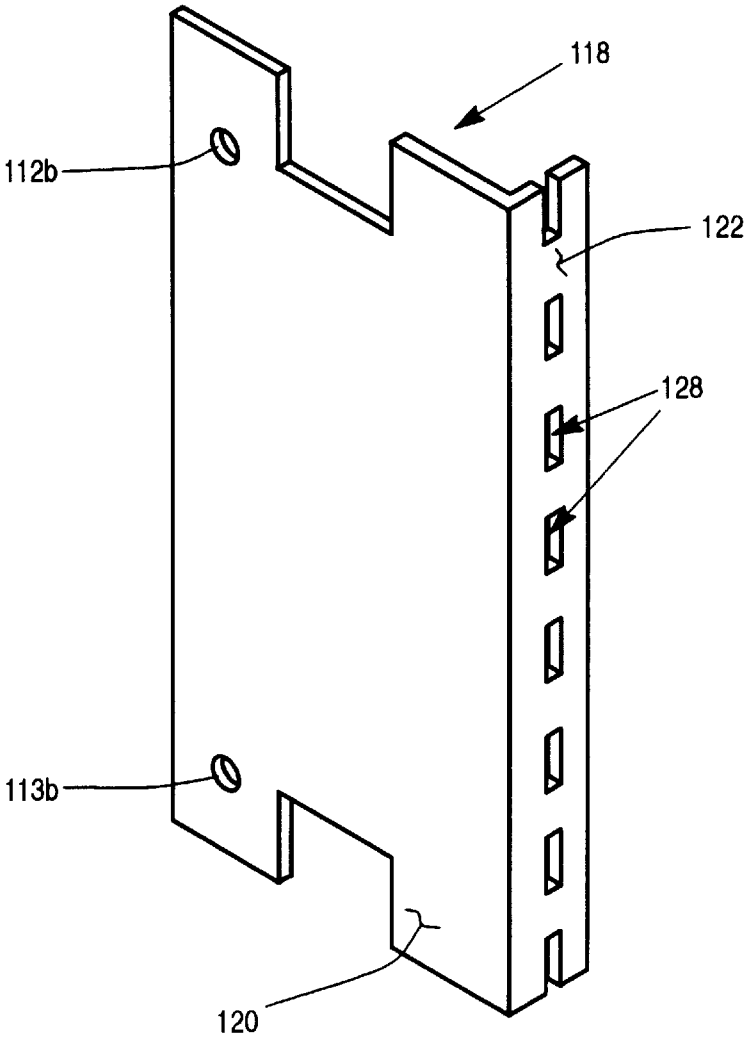
FIG. 7 is a perspective view of a rack-mount joint.

FIG. 7 is a perspective view of a rack-mount joint 118. As described above, the joint fits between upper mating flange 86 and lower mating flange 87 of an associated side unit. Rack-mount joint 118 has bracket mating surface 120, and a rack support member 122 that is at a predetermined angle from bracket mating surface 120. In the preferred embodiment, the predetermined angle is approximately 90 degrees. Rack support member 122 has a plurality of rack-mount slots 128 described further below.

Figure 8:
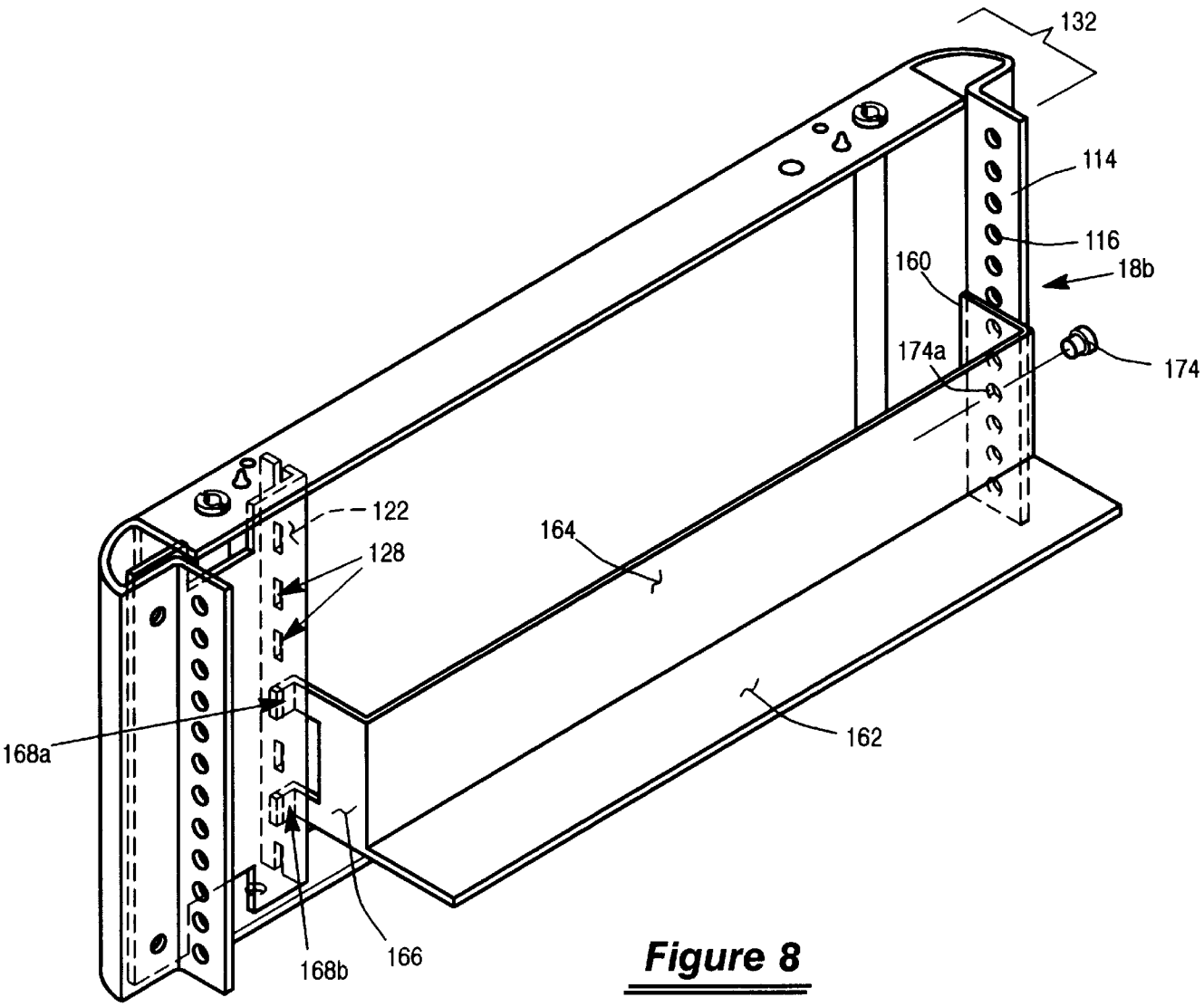
FIG. 8 is a perspective view of a modular side unit including a support rack.

FIG. 8 is a perspective view of modular side unit 18*b* including a support rack 160. Support rack 160 has a device (subassembly) support surface 162 and a side guide surface 164. Side guide surface 164 has rack-joint surface 166 for mating with rack support member 122. Rack-joint surface 166 is at a predetermined angle from side guide surface 164 which in the preferred embodiment is approximately 90 degrees. Support rack 160 further has insertion prongs 168*a* and 168*b* formed at a predetermined angle to rack-joint surface 166, which in the preferred embodiment is 90 degrees. Each insertion prong 168*a* and 168*b* is for inserting into a selected respective one of rack-mount slots 128. Support rack 160 may be mounted to side unit 18*b* in varying relationships depending on the rack-mount slots 128 which are selected to receive the respective insertion prongs 168*a* and 168*b*.

Support rack 160 further has a support bracket 172 which is integrally formed thereto at a predetermined angle, which in the preferred embodiment is 90 degrees. Support bracket 172 has a mating hole 174*a*. Support bracket 172 mates with terminating portion 114 of back bracket 132 of side unit 18*b*, and is attached thereto with fastener 174. Fastener 174 is inserted through mating hole 174*a*, and further inserted through a respective one of device mounting holes 116 of back bracket 132. In the preferred embodiment, fastener 174 is a screw.

Figure 9:
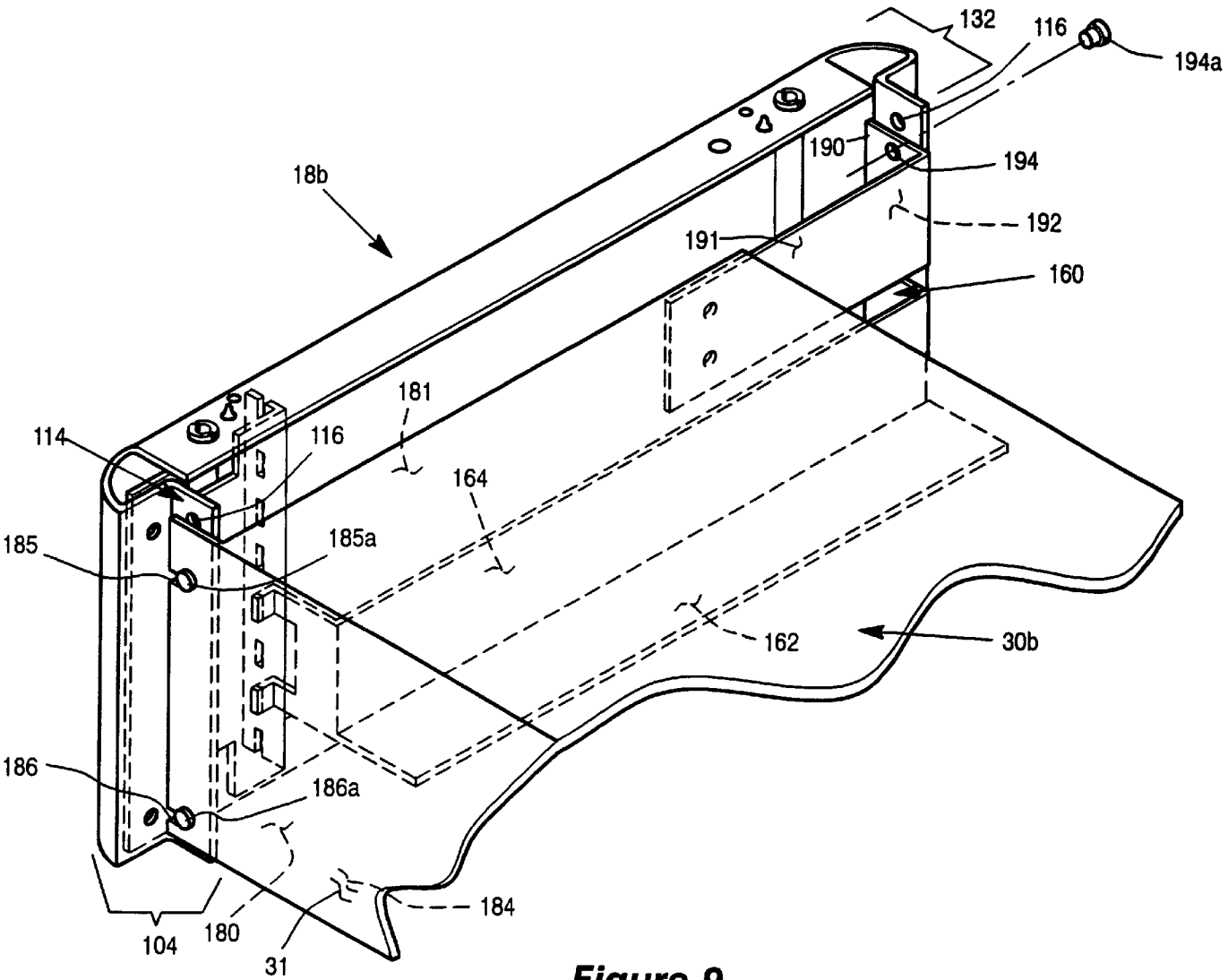
FIG. 9 is a perspective view of a subassembly supported on a support rack and attached to a side unit.

FIG. 9 is a perspective view of subassembly 30*b* supported on support rack 160 and attached to side unit 18*b*. Subassembly 30*b* has a bottom surface 180 which rests upon, and is supported by, device support surface 162. Subassembly 30*b* further has a side surface 181 which rests against side guide surface 164, and a front mating surface 31 which mates with unit mating surface 32 (discussed above). Subassembly 30*b* has a bracket mating surface 184 which mates with terminating portion 114 of front bracket 104 of side unit 18*b*. Bracket mating surface 184 has two front mating surface holes 185 and 186. Device 30*b* is mounted to side unit 18*b* by inserting fastener 185*a* through front mating surface hole 185, and further through a respective one of device mounting holes 116 of front bracket 104. Likewise, fastener 186*a* is inserted through front mating surface hole 186, and further inserted through a different respective one of device mounting holes 116 of front bracket 104.

Subassembly 30*b* further has a side mount bracket 190. Side mount bracket 190 has a side mating surface 191, and a bracket mating surface 192. Side mating surface 191 mates with, and is attached to, side surface 181 using any commercially-available fasteners. Bracket mating surface 192 is at a predetermined angle from side mating surface 191, which in the preferred embodiment is 90 degrees. Bracket mating surface 192 has a bracket hole 194. Fastener 194*a* is inserted into bracket hole 194, and into one of device mounting holes 116 of back bracket 132.

In a like manner, subassembly 30*b* is attached to oppositely-positioned side unit 20*b* (shown in FIG. 1). Attaching subassembly 30*b* Side panel 18*b* and 20*b* provides an added dimension of strength and stability to module 12. Subassembly 30*b* holds side units 18*b* and 22*b* in a predetermined relationship to one another. Fastening pins 52*b*, 54*b*, 56*b*, and 58*b*, the side units 18*b* and 20*b*, and subassembly 30*b* are therefore interlocked into a very strong, stable structure which can withstand a large amount of torquing force, and can further support a large amount of weight.

Although it is understood that side units may be stacked without being connected to subassemblies, connecting side units to subassemblies provides a stronger module structure.

Figure 10:
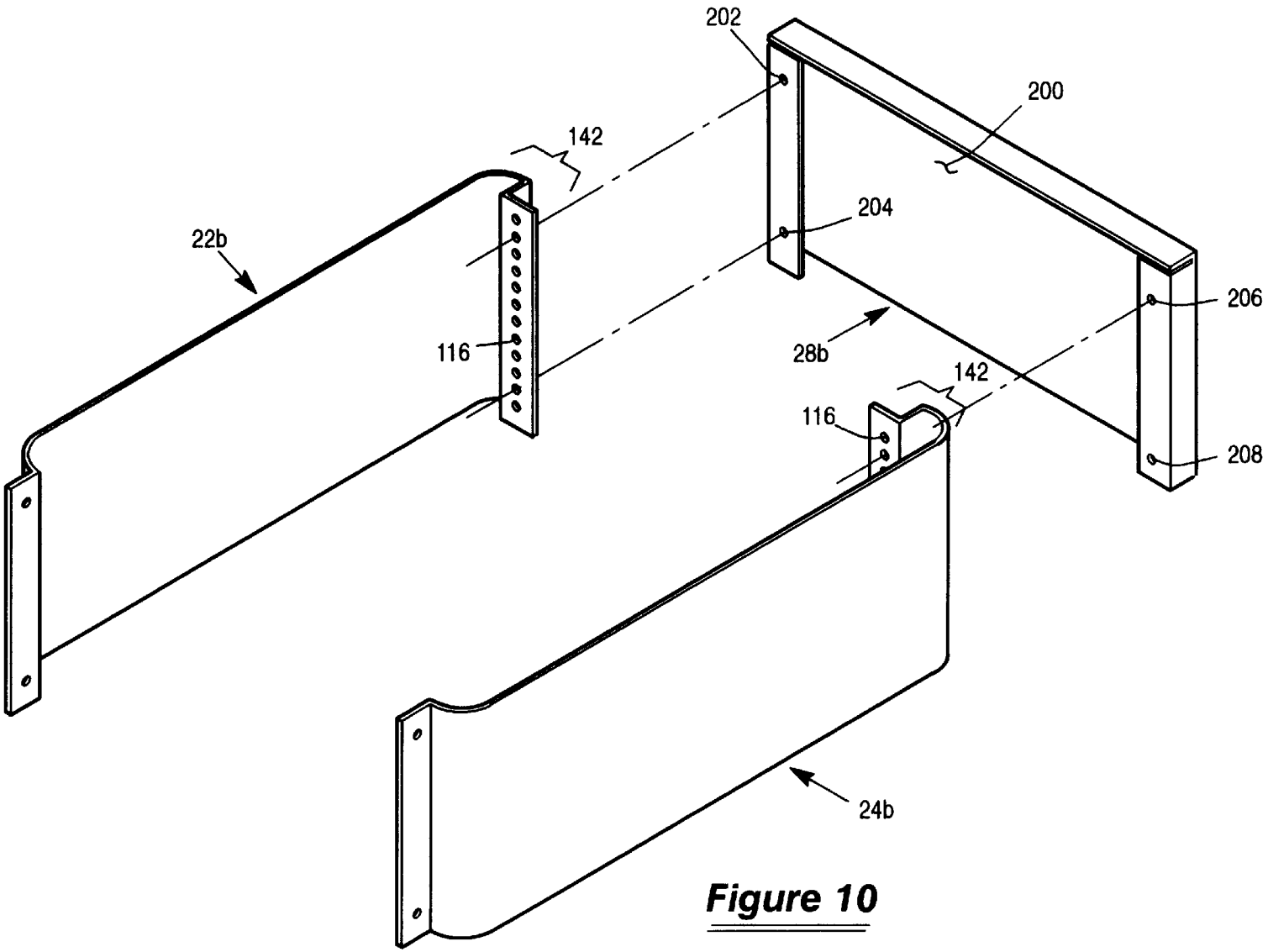
FIG. 10 is an exploded perspective view of two side extension units as they attach to a back panel

FIG. 10 is an exploded perspective view of two side extension units as they attach to a back panel. As discussed above, side extension units 22*b* and 24*b* have extension brackets 142 possessing all of the attributes described with respect to FIG. 4. Back panel 28*b* has a back panel mating surface 200 for mating with the terminating portions 114 of extension brackets 142 of side extension units 22*b* and 24*b*. Back panel mating surface 200 has four back panel pegs 202, 204, 206, and 208 for attaching back panel 28*b* to side extension units 22*b* and 24*b*. Back panel pegs 202 and 204 are inserted into different respective ones of device mounting holes 116 of extension bracket 142 of side extension unit 22*b*. Likewise, back panel pegs 206 and 208 are inserted into different respective ones of device mounting holes 116 of extension bracket 132 of side extension unit 24*b*.

Side extension units are used to extend cabinet capacity. Modules may need the added capacity to accommodate larger electronic subassemblies or to meet cabling requirements, for example. However, if the additional capacity is not required, back panels may be fastened directly to the side unit back brackets. For example, if side extension units 22*b* and 24*b* were not required in module 12, back panel mating surface 200 would mate with terminating portions 114 of back brackets 132 of side units 18*b* and 20*b*. Back panel pegs 202 and 204 would be inserted into different respective ones of device mounting holes 116 of back bracket 132 of side unit 18*b*. Likewise, back panel pegs 206 and 208 would be inserted into different respective ones of device mounting holes 116 of back bracket 132 of side unit 20*b*. Finally, it should be noted that back panels 28*a* and 28*b* merely provide aesthetic appeal, not structural support, to the cabinet. It is understood the cabinet could be constructed without these additional components.

The above paragraphs describe a stackable modular cabinet in which the modules are stacked in a vertical manner, with module 10 stacked upon module 12. However, the stackable modular cabinet may be positioned on one side so that cabinet expansion occurs laterally. For example, the cabinet of FIG. 1 could be positioned so side units 18*a* and

18*b* are in contact with a desktop or floor. This positioning may be useful if space constraints exist.

The invention has been described in its presently contemplated best mode, and it is clear that it is susceptible to various modifications, modes of operation and embodiments, all within the ability and skill of those skilled in the art and without the exercise of further invention activity. Accordingly, what is intended to be protected by Letter Patents is set forth in the appended claims.

What is claimed is:

1. For use in forming one of a plurality of interlocking modules of a stackable modular cabinet, a modular side unit, comprising:

a side panel having an interior surface, an exterior surface, a front bracket edge, a back bracket edge, an upper mating edge, and a lower mating edge;

a front bracket attached to said front bracket edge having a first transitional portion, and a first terminating portion, said first terminating portion having a plurality of device mounting holes positioned at a predetermined spacing in said first terminating portion;

a back bracket attached to said back bracket edge having a second transitional portion, and a second terminating portion, said second terminating portion having a plurality of device mounting holes positioned at a predetermined spacing in said second terminating portion;

an associated upper mating shelf attached to said upper mating edge and having a top mating surface, and a plurality of upper pin holes;

an associated lower mating shelf attached to said lower mating edge to couple to a respectively associated upper mating shelf of a different one of the plurality of interlocking modules and having a bottom mating surface and a plurality of lower pin holes, each one of said upper pin holes approximately axially aligned with a corresponding one of said lower pin holes; and a plurality of fastening pins, each of said fastening pins having first and second ends, each said first end to extend through an associated one of said lower pin holes and each said second end to extend through an associated one of said upper pin holes, said first end to selectively engage a second end of a respectively associated one of a plurality of fastening pins of a different one of the plurality of interlocking modules.

2. The modular side unit of claim 1, and further comprising:

a rack-mount joint extending substantially between said associated upper mating shelf and said associated lower mating shelf, said rack-mount joint having a bracket mating surface to mount to said first transitional portion of said front bracket, said rack-mount joint farther having a rack support surface, said rack support surface having a plurality of rack support holes.

3. The modular side unit of claim 1 wherein each of said first and second transitional portions further comprises:

an arcuate portion of approximately 90 degrees curving towards said interior surface; and an intermediate planar portion extending towards and approximately parallel with said side panel.

4. The modular side unit of claim 3 wherein said each of said terminating portions consist of a planar portion extending away from said intermediate planar portion at a predetermined angle.

5. The modular side unit of claim 2, and further comprising:

a plurality of upper shelf fastening holes in said associated upper mating shelf;

a similar plurality of lower shelf fastening holes in said associated lower mating shelf, each of said lower shelf fastening holes being approximately axially aligned with a corresponding one of said plurality of upper shelf fastening holes; and a plurality of fastening devices, each of said plurality of fastening devices inserted in an associated different one of said lower shelf fastening holes and further inserted in an associated corresponding one of a plurality of upper shelf fastening holes in a different associated modular side unit of the different one of the plurality of interlocking modules, whereby said modular side unit is attached to the different associated modular side unit of the different one of the plurality of interlocking modules.

6. The modular side unit of claim 1, and further comprising:

a plurality of positioning protrusions on said associated upper mating shelf; and a plurality of positioning holes in said associated lower mating shelf, each said positioning hole approximately axially aligned with an associated one of said plurality of positioning protrusions to mate with an associated one of said positioning protrusions of a different associated modular side unit of the different one of the plurality of interlocking modules.

7. The modular side unit of claim 1, and further comprising:

an extension unit having a predetermined height and length and having an extension mating surface, whereby said extension unit can mount to said back bracket.

8. For use in a stackable modular cabinet, a stackable module comprising:

first and second side units, each one of said side units having a front bracket having a front terminating portion having a plurality of device mounting holes at a predetermined position within said front terminating portion, each one of said side units further having a back bracket having a back terminating portion having a plurality of device bracket mounting holes at a predetermined position within said back terminating portion, each one of said side units further having an upper mating shelf and a lower mating shelf, said upper mating shelf to couple to a lower mating shelf of a different associated side unit in a different stackable module, each one of said first and second side units having a plurality of selectively actuatable locking mechanisms extending from said upper mating shelf to said lower mating shelf, each said selectively actuatable locking mechanism designed to couple to an associated selectively actuatable locking mechanism of the different associated side unit in the different stackable module; and a front fascia panel removably mounted to said front bracket of said first side unit and said front bracket of said second side unit.

9. The stackable module of claim 8, wherein each of said first side unit and said second side unit further comprises:

a rack-mount joint positioned between said upper mating shelf and said lower mating shelf, said rack-mount joint having a bracket mating surface whereby said rack-mount joint can mount to said front bracket, said rack-mount joint further having a rack support surface having a plurality of rack support apertures; and a support rack having a rack-joint interconnection structure to interlock with selected ones of said rack support apertures, said support rack further having a support bracket to mount to said back bracket, and said support rack further having a support surface.

10. The stackable module of claim 9, and further comprising:

a subassembly having a bottom surface supported by said support surface of said support rack of said first side unit and said support surface of said support rack of said second side unit, said subassembly further having a front bracket mating surface to selectively mount to associated ones of said device mounting holes of said first side unit and said second side unit.

11. The stackable module of claim 10, and further comprising:

a first subassembly mounting mechanism mounted to said subassembly and having a first fastening mechanism to mount to selected ones of said device bracket mounting holes of said back bracket of said first side unit; and a second subassembly mounting mechanism mounted to said subassembly and having a second fastening mechanism to mount to selected ones of said device bracket mounting holes of said back bracket of said second side unit.

12. The stackable module of claim 8, and further comprising:

a back panel having a first set of fastening members and a second set of fastening members to removably mount said back panel to said back bracket of said first side unit and to said back bracket of said second side unit.

13. The stackable module of claim 8, and further comprising:

a first extension unit of predetermined height and length and having an extension mating surface to mount to said back bracket of said first side unit, said first extension unit further having a first extension bracket;

a second extension unit of predetermined height and length and having an extension mating surface to mount to said back bracket of said second side unit, said second extension unit further having an second extension bracket; and a back panel having a first set of fastening members and a second set of fastening members to respectively removably mount to said first extension bracket of said first extension unit and to said second extension bracket of said second extension unit.

14. For use in a modular stackable cabinet structure having a plurality of modular side units, a modular side unit comprising:

a panel member having a predetermined length, upper and lower edges, and first and second ends, said panel member including a first cabinet support member and a second cabinet support member coupled respectively to said upper and lower edges along a predetermined part of said predetermined length, said first cabinet support member to cooperate with an associated second cabinet support member of a different one of the plurality of modular side units, and said second cabinet support member to cooperate with an associated first cabinet support member of a yet different one of the plurality of modular side units;

a first selectively actuatable locking mechanism mounted on said first end intermediate said first and second cabinet support members to selectively engage a first selectively actuatable locking mechanism of the different one of the plurality of modular side units, and to further selectively engage a first selectively actuatable locking mechanism of the yet different one of the plurality of modular side units;

a second selectively actuatable locking mechanism mounted on said second end intermediate said first and second cabinet support members to selectively engage a second selectively actuatable locking mechanism of the different one of the plurality of modular side units, and to further selectively engage a second selectively actuatable locking mechanism of the yet different one of the plurality of modular side units;

a first end coupling structure mounted at said first end;

a second end coupling structure mounted at said second end; and a subassembly mounting structure mounted to said panel member, said subassembly mounting structure including a stiffening member in proximity to said first end and extending substantially from said first cabinet support member to said second cabinet support member, and further including a subassembly support member.

15. A modular side unit as in claim 14, wherein each of said selectively actuatable locking mechanisms includes a first aperture in said first cabinet support member and an oppositely disposed second aperture in said second cabinet support member;

a pin structure having a first end retained in said first aperture and a second end retained in said second aperture, said first end of said pin structure having a first cooperative locking structure and said second end of said pin structure having a second cooperative locking structure.

16. A modular side unit as in claim 15 wherein said first cooperative locking structure includes a tapped receiving channel having a first predetermined depth; and an actuating mechanism.

17. A modular side unit as in claim 16 wherein said second cooperative locking structure includes a threaded insertion portion having a length shorter than said first predetermined depth in said tapped receiving channel.

18. A modular side unit as in claim 16 wherein said second cooperative locking structure includes an additional tapped receiving channel having a second predetermined depth; and a peg having a first threaded end mounted in said additional tapped receiving channel and a second threaded interlocking end, whereby said second threaded interlocking end can interlock with a tapped receiving channel of a different associated pin structure.

19. For use supporting assemblies wherein each assembly has a front, rear, and first and second sides, a stackable modular cabinet, comprising:

a plurality of module means, each of said plurality of module means for supporting an associated one of the plurality of assemblies and having a front means for enclosing the front of the associated one of the plurality of assemblies, a rear means for enclosing the rear of the associated one of the plurality of assemblies, a first side means and a second side means for enclosing the first and second sides of the associated one of the plurality of assemblies, respectively, said first side means and said second side means each having a front bracket means for removably mounting to said front means, and further having a back bracket means for removably mounting to said rear means, said first side means and said second side means each further having an upper flange means for supporting a different one of said plurality of module means, and having a lower flange means for mating with said upper flange means of a still different one of said plurality of module means, a plurality of fastening means associated with said each of said plurality of module means, each of said plurality of fastening means having a first and second cooperative locking means, said first cooperative locking means for interlocking to a second cooperative locking means of a different one of said plurality of fastening means associated with said different one of said plurality of module means, and said second cooperative locking means for interlocking to a first cooperative locking means of a yet different one of said plurality of fastening means associated with said still different one of said plurality of module means.

20. The stackable modular cabinet of claim 21, and further comprising:

a base means for supporting said plurality of module means; and a cover means for mating with and attaching to an associated one of said plurality of module means.

21. The stackable modular cabinet of claim 20, wherein at least a selected one of said plurality of module means further includes:

a first extension means for extending the size of the selected one of said plurality of module means, said first extension means having a mounting means for mounting to said back bracket means of said first side means, said first extension means further having an extension bracket means for mounting an associated end of said rear means; and a second extension means for extending the size of the selected one of said plurality of module means, said second extension means having a mounting means for mounting to said back bracket means of said second side means, said second extension means further having an extension bracket means for mounting a different associated end of said rear means.

22. The stackable modular cabinet of claim 21, wherein each of said plurality of module means further comprises:

first rack support means interposed between said upper flange means and said lower flange means of said first side means and second rack support means interposed between said upper flange means and said lower flange means of said second side means, said first rack support means and said second rack support means for supporting the associated one of the plurality of assemblies, said first rack support means and said second rack support means having first and second front bracket mating means, respectively, for mounting to said front bracket means of said first side means and said second side means, respectively, said first rack means and said second rack means having first and second rack interface means, respectively; and first and second rack means each having an interface means for interlocking with said first rack interface means and said second rack interface means, respectively, said first rack means and said second rack means having first and second bracket means, respectively, for mounting to said back bracket means of said first side means and said second side means, respectively, said first rack means and said second rack means having first and second device support means, respectively.

23. The stackable modular cabinet of claim 22, wherein each of said plurality of module means further comprises:

a subassembly means having a surface means for interfacing with said first device support means and said second device support means, said subassembly means having a subassembly mounting means for mounting to said front bracket means of said first side means and said second side means, said subassembly means having a first and second back mounting means for mounting to said back bracket means of said first side means and said second side means, respectively.

24. For use in a modular cabinet structure having a plurality of side panels, a mounting structure comprising:

an elongated channel member having a predetermined length and having a first end and a second end oppositely disposed from said first end, said elongated channel member extending longitudinally between said first end and said second end and further having a pair of spaced apart sides, one of said sides adapted to cooperate with a side panel;

first and second pin retention flange members mounted on said first and second ends, respectively, said first pin retention flange member to cooperate with a respectively associated second pin retention flange member of a different mounting structure and said seconds pin retention flange member to cooperate with a respectively associated first pin retention flange member of a yet different mounting structure; and a locking pin extending substantially along said length of said elongated channel member from said first pin retention flange member at said first end to said second pin retention flange member at said second end and cooperatively retained by said first and second pin retention flange members, said locking pin having an insertion locking end and a receiving locking end, said insertion locking end capable of cooperating with a receiving locking end of a different locking pin, and said receiving locking end capable of cooperating with a insertion locking end of a still different locking pin to form a substantially rigid interlocked continuous structure for providing structural strength to the modular cabinet structure.

25. For use in interlocking the modules of a stackable modular cabinet having a plurality of selectively releasable interconnecting structures, a selectively releasable interconnecting structure, comprising:

a panel member having first and second end edges and a side edge;

first and second support members attached to said first and second end edges, respectively, said first and second support member each having a pin hole;

a coupling structure mounted to said side edge having an elongated channel and a pair of spaced-apart sides; and a fastening pin extending between said first and second support members, said fastening pin having a threaded insertion end and a bored and tapped receiving channel, whereby said threaded insertion end may be inserted through a pin hole of a second support member of a different one of the plurality of selectively releasable interconnecting structures to interlock in the receiving channel of a respectively associated fastening pin.

26. The selectively releasable interconnecting structure of claim 25 and further including a stiffening member extending substantially from said first support member to said second support member.

27. For use in forming one of a plurality of interlocking modules of a stackable modular cabinet, a modular side unit, comprising:

a side panel having an interior surface, an exterior surface, a front bracket edge, a back bracket edge, an upper mating edge, and a lower mating edge;

a front bracket attached to said front bracket edge having a first transitional portion, and a first terminating portion, said first transitional portion including an arcuate portion of approximately 90 degrees curving toward said interior surface and an intermediate planar portion extending toward and approximately parallel with said side panel, said first terminating portion having a plurality of device mounting holes positioned at a predetermined spacing in said first terminating portion;

a back bracket attached to said back bracket edge having a second transitional portion, and a second terminating portion, said second transitional portion including an arcuate portion of approximately 90 degrees curving toward said interior surface and an intermediate planar portion extending toward and approximately parallel with said side panel, said second terminating portion having a plurality of device mounting holes positioned at a predetermined spacing in said second terminating portion;

an upper mating shelf attached to said upper mating edge and having a top mating surface, and a plurality of upper pin holes; and a lower mating shelf attached to said lower mating edge and having a bottom mating surface and a plurality of lower pin holes, each one of said upper pin holes approximately axially aligned with a corresponding one of said lower pin holes.

28. The modular side unit of claim 27 wherein said each of said terminating portions consist of a planar portion extending away from said intermediate planar portion at a predetermined angle.

29. For use in forming one of a plurality of interlocking modules of a stackable modular cabinet, a modular side unit, comprising:

a side panel having an interior surface, an exterior surface, a front bracket edge, a back bracket edge, an upper mating edge, and a lower mating edge;

a front bracket attached to said front bracket edge having a first transitional portion, and a first terminating portion, said first terminating portion having a plurality of device mounting holes positioned at a predetermined spacing in said first terminating portion;

a back bracket attached to said back bracket edge having a second transitional portion, and a second terminating portion, said second terminating portion having a plurality of device mounting holes positioned at a predetermined spacing in said second terminating portion;

an upper mating shelf attached to said upper mating edge and having a top mating surface, a plurality of upper pin holes, and a plurality of upper shelf fastening holes;

a lower mating shelf attached to said lower mating edge and having a bottom mating surface, a plurality of lower pin holes, and a plurality of lower shelf fastening holes, each one of said upper pin holes approximately axially aligned with a corresponding one of said lower pin holes, and each one of said upper shelf fastening holes approximately axially aligned with a corresponding one of said lower shelf fastening holes; and a plurality of fastening devices, each of said plurality of fastening devices inserted in an associated different one of said lower shelf fastening holes and further inserted in an associated corresponding one of a plurality of upper shelf fastening holes in a different associated modular side unit whereby said modular side unit is attachable to the different associated modular side unit.

30. For use in forming one of a plurality of interlocking modules of a stackable modular cabinet, a modular side unit, comprising:

a side panel having an interior surface, an exterior surface, a front bracket edge, a back bracket edge, an upper mating edge, and a lower mating edge;

a front bracket attached to said front bracket edge having a first transitional portion, and a first terminating portion, said first terminating portion having a plurality of device mounting holes positioned at a predetermined spacing in said first terminating portion;

a back bracket attached to said back bracket edge having a second transitional portion, and a second terminating portion, said second terminating portion having a plurality of device mounting holes positioned at a predetermined spacing in said second terminating portion;

an upper mating shelf attached to said upper mating edge and having a top mating surface, and a plurality of upper pin holes, said top mating surface having a plurality of positioning protrusions; and a lower mating shelf attached to said lower mating edge and having a bottom mating surface, a plurality of lower pin holes and a plurality of positioning holes, each one of said plurality of upper pin holes approximately axially aligned with a corresponding one of said lower pin holes, and each one of said plurality of positioning holes approximately axially aligned with an associated one of said plurality of positioning protrusions to mate with an associated one of the plurality of positioning protrusions of a different associated modular side unit.

31. For use in forming one of a plurality of interlocking modules of a stackable modular cabinet, a modular side unit, comprising:

a side panel having an interior surface, an exterior surface, a front bracket edge, a back bracket edge, an upper mating edge, and a lower mating edge;

a front bracket attached to said front bracket edge having a first transitional portion, and a first terminating portion, said first terminating portion having a plurality of device mounting holes positioned at a predetermined spacing in said first terminating portion;

a back bracket attached to said back bracket edge having a second transitional portion, and a second terminating portion, said second terminating portion having a plurality of device mounting holes positioned at a predetermined spacing in said second terminating portion;

an upper mating shelf attached to said upper mating edge and having a top mating surface, and a plurality of upper pin holes;

a lower mating shelf attached to said lower mating edge and having a bottom mating surface and a plurality of lower pin holes, each one of said upper pin holes approximately axially aligned with a corresponding one of said lower pin holes;

an extension unit having a predetermined height and length and having an extension mating surface, whereby said extension unit can mount to said back bracket; and a plurality of fastening devices, each of said plurality of fastening devices to insert in an associated different one of said plurality of lower pin holes and being capable of attachment to a second side panel said each of said plurality of fastening devices further to insert in said upper pin hole axially aligned with said associated different one of said plurality of lower pin holes and being capable of attachment to a third side panel.

32. For use in a stackable modular cabinet, a stackable module comprising:

first and second side units, each one of said side units having a front bracket having a front terminating portion having a plurality of device mounting holes at a predetermined position within said front terminating portion, each one of said side units further having a back bracket having a back terminating portion having a plurality of device bracket mounting holes at a predetermined position within said back terminating portion, each one of said side units further having an upper mating shelf, a lower mating shelf, and a rack-mount joint positioned between said upper and said lower mating shelves and having a bracket mating surface whereby said rack-mount joint can mount to said front bracket, said rack-mount joint further having a rack support surface having a plurality of rack support apertures, each one of said side units further having a plurality of selectively actuatable locking mechanisms mounted intermediate said upper mating shelf and said lower mating shelf;

a front fascia panel removably mounted to said front bracket of said first side unit and said front bracket of said second side unit;

first and second support racks, each having a rack-joint interconnection structure to interlock with selected ones of said rack support apertures of a respective one of said first and second side units, each of said first and second support racks further having a support bracket to mount to said back bracket of said respective one of said first and second side unit, and each of said first and second support racks further having a support surface.

33. The stackable module of claim 32, and further comprising:

a subassembly having a bottom surface supported by said support surfaces of said first support rack and said second support rack, said subassembly further having a front bracket mating surface to selectively mount to associated ones of said device mounting holes of said first side unit and said second side unit.

34. The stackable module of claim 33, and further comprising:

a first subassembly mounting mechanism mounted to said subassembly and having a first fastening mechanism to mount to selected ones of said device bracket mounting holes of said back bracket of said first side unit; and a second subassembly mounting mechanism mounted to said subassembly and having a second fastening mechanism to mount to selected ones of said device bracket mounting holes of said back bracket of said second side unit.

35. For use in a stackable modular cabinet, a stackable module comprising:

first and second side units, each one of said side units having a front bracket having a front terminating portion having a plurality of device mounting holes at a predetermined position within said front terminating portion, each one of said side units further having a back bracket having a back terminating portion having a plurality of device bracket mounting holes at a predetermined position within said back terminating portion, each one of said side units further having an upper mating shelf and a lower mating shelf, each one of said side units having a plurality of selectively actuatable locking mechanisms mounted intermediate said upper mating shelf and said lower mating shelf;

a front fascia panel removably mounted to said front bracket of said first side unit and said front bracket of said second side unit;

a first extension unit of predetermined height and length and having an extension mating surface to mount to said back bracket of said first side unit, said first extension unit further having a first extension bracket;

a second extension unit of predetermined height and length and having an extension mating surface to mount to said back bracket of said second side unit, said second extension unit further having a second extension bracket; and a back panel having a first set of fastening members and a second set of fastening members to removably mount to said first extension bracket and to said second extension bracket, respectively.

36. For use in a modular stackable cabinet structure, a modular side unit comprising:

a panel member having a predetermined length, upper and lower edges, and first and second ends, said panel member including first and second cabinet support members coupled respectively to said upper and lower edges along a predetermined part of said length;

a first and second selectively actuatable locking mechanism mounted on said first and said second ends, respectively, each of said selectively actuatable locking mechanisms including a first aperture in said first cabinet support member, and an oppositely disposed second aperture in said second cabinet support member, each of said selectively actuatable locking mechanisms further having a pin structure having a first end having a first cooperative locking structure to be retained in said first aperture, said pin structure further having a second end having a second cooperative locking structure to be retained in said second aperture;

a first end coupling structure mounted at said first end of said panel member;

a second end coupling structure mounted at said second end of said panel member; and a subassembly mounting structure mounted to said panel member, said subassembly mounting structure including a stiffening member in proximity to said first end of said panel member and intermediate said first and second cabinet support members, and further including a subassembly support member.

37. A modular side unit as in claim 36 wherein said first cooperative locking structure includes a tapped receiving channel having a first predetermined depth; and an actuating mechanism.

38. A modular side unit as in claim 37 wherein said second cooperative locking structure includes a threaded insertion portion having a length shorter than said first predetermined depth in said tapped receiving channel.

39. A modular side unit as in claim 37 wherein said second cooperative locking structure includes an additional tapped receiving channel having a second predetermined depth; and a peg having a first threaded end mounted in said additional tapped receiving channel and a second threaded interlocking end, whereby said second threaded interlocking end can interlock with said tapped receiving channel of a different associated pin structure.

40. For use supporting assemblies wherein each assembly has a front, rear, and first and second sides, a stackable modular cabinet, comprising:

a plurality of module means, each for supporting an associated one of the assemblies, each of said plurality of module means having a front means for enclosing the front of said associated one of the assemblies, a rear means for enclosing the rear of said associated one of the assemblies, a first side means and a second side means for enclosing the first and second sides of said associated one of the assemblies, respectively, each of said side means having a front bracket means for removably mounting to said front means, each of said side means further having a back bracket means for removably mounting to said rear means, each of said side means further having an upper flange means for supporting a different one of said plurality of module means, each of said side means having a lower flange means for mating with said upper flange means of a still different one of said plurality of module means;

a plurality of fastening means associated with predetermined ones of said plurality of module means, each of said plurality of fastening means having a first and second cooperative locking means for interlocking to associated locking means of a different associated one of said plurality of fastening means;

a base means for supporting said plurality of module means;

a cover means for mating with and attaching to an associated one of said plurality of module means;

a first extension means for extending the size of an associated one of said plurality of module means, said first extension means having a mounting means for mounting to said back bracket means of said first side means, said first extension means further having an extension bracket means for mounting an associated end of said rear means; and a second extension means for extending the size of an associated one of said plurality of module means, said second extension means having a mounting means for mounting to said back bracket means of said second side means, said second extension means further having an extension bracket means for mounting an associated end of said rear means.

41. The stackable modular cabinet of claim 40, wherein each of said plurality of module means further comprises:

a first and second rack support means interposed between said upper flange means and said lower flange means of said first side means and said second side means for supporting an associated assembly, said first rack support means and said second rack support means having a first and second front bracket mating means, respectively, for mounting to said front bracket means of said first side means and said second side means, respectively, said first rack means and said second rack means having a first and second rack interface means, respectively; and a first and second rack means having an interface means for interlocking with said first rack interface means and said second rack interface means, respectively, said first rack means and said second rack means having a first and second bracket means, respectively, for mounting to said back bracket means of said first side means and said second side means, respectively, said first rack means and said second rack means having a first and second device support means, respectively.

42. The stackable modular cabinet of claim 41, wherein each of said plurality of module means further comprises:

a subassembly means having a surface means for interfacing with said first device support means and said second device support means, said subassembly means having a subassembly mounting means for mounting to said front bracket means of said first side means and said second side means, said subassembly means having a first and second back mounting means for mounting to said back bracket means of said first side means and said second side means, respectively.

* * * * *